US011215183B2

(12) United States Patent
Brown et al.

(10) Patent No.: US 11,215,183 B2
(45) Date of Patent: Jan. 4, 2022

(54) ELECTRIC SUBMERSIBLE PUMP (ESP) TENSIONING

(71) Applicant: Halliburton Energy Services, Inc., Houston, TX (US)

(72) Inventors: Donn J. Brown, Broken Arrow, OK (US); Trevor Alan Kopecky, Owasso, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 168 days.

(21) Appl. No.: 16/703,568

(22) Filed: Dec. 4, 2019

(65) Prior Publication Data

US 2021/0172443 A1 Jun. 10, 2021

(51) Int. Cl.

| | |
|---|---|
| ***E21B 43/12*** | (2006.01) |
| ***F04D 13/10*** | (2006.01) |
| ***F04D 15/00*** | (2006.01) |
| ***F04D 29/66*** | (2006.01) |

(52) U.S. Cl.

CPC ..... *F04D 13/10* (2013.01); *E21B 43/128* (2013.01); *F04D 15/0077* (2013.01); *F04D 29/669* (2013.01)

(58) Field of Classification Search

CPC ..... F04D 7/02; F04D 13/086; F04D 13/10; F04D 29/426; F04D 29/606; F04B 49/065; F04B 2201/0802; F04B 2203/0206

See application file for complete search history.

(56) References Cited

U.S. PATENT DOCUMENTS

| | | | | |
|---|---|---|---|---|
| 9,752,392 | B2 | 9/2017 | Semple et al. | |
| 10,920,512 | B2 * | 2/2021 | Liu | E21B 17/1021 |
| 2010/0108382 | A1 * | 5/2010 | Ma | E21B 17/1014 175/24 |
| 2010/0258304 | A1 | 10/2010 | Hegeman | |
| 2012/0251362 | A1 * | 10/2012 | Forsberg | F04D 1/06 417/423.12 |
| 2013/0062075 | A1 * | 3/2013 | Brennan, III | E21B 17/1014 166/381 |
| 2015/0004031 | A1 * | 1/2015 | Mack | F04D 29/669 417/423.3 |
| 2015/0252621 | A1 * | 9/2015 | Tunget | E21B 17/1078 175/61 |
| 2018/0030785 | A1 | 2/2018 | Jeffryes | |

FOREIGN PATENT DOCUMENTS

| | | |
|---|---|---|
| CN | 206000502 U | 3/2017 |
| EP | 0250107 B1 | 8/1992 |

OTHER PUBLICATIONS

Foreign Communication from Related Application—International Search Report and Written Opinion of the International Searching Authority, International Application No. PCT/US2019/065164, dated Aug. 28, 2020, 13 pages.

* cited by examiner

*Primary Examiner* — Charles G Freay
(74) *Attorney, Agent, or Firm* — Conley Rose, P.C.; Rodney B. Carroll

(57) ABSTRACT

An electric submersible pump (ESP) assembly. The ESP assembly comprises a first actuator having a first member that is configured to extend and retract radially with respect to a central axis of the ESP assembly in response to receiving a control input, wherein the first actuator is mechanically coupled to an electric motor, to a seal section, or to a centrifugal pump of the ESP assembly.

20 Claims, 7 Drawing Sheets

ELECTRIC SUBMERSIBLE PUMP (ESP) TENSIONING

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (hereafter "ESP" or "ESPs") may be used to lift production fluid in a wellbore. Specifically, ESPs may be used to pump the production fluid to the surface in wells with low reservoir pressure. ESPs may be of importance in wells having low bottomhole pressure or for use with production fluids having a low gas/oil ratio, a low bubblepoint, a high water cut, and/or a low API gravity. Moreover, ESPs may also be used in any production operation to increase the flow rate of the production fluid to a target flow rate.

Generally, an ESP comprises an electric motor, a seal section, a pump intake, and one or more pump (e.g., a centrifugal pump). These components may all be connected with a series of shafts. For example, the pump shaft may be coupled to the motor shaft through the intake and seal shafts. An electric power cable provides electric power to the electric motor from the surface. The electric motor supplies mechanical torque to the shafts, which provide mechanical power to the pump. Fluids, for example reservoir fluids, may enter the wellbore where they may flow past the outside of the motor to the pump intake. These fluids may then be produced by being pumped to the surface inside the production tubing via the pump, which discharges the reservoir fluids into the production tubing.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
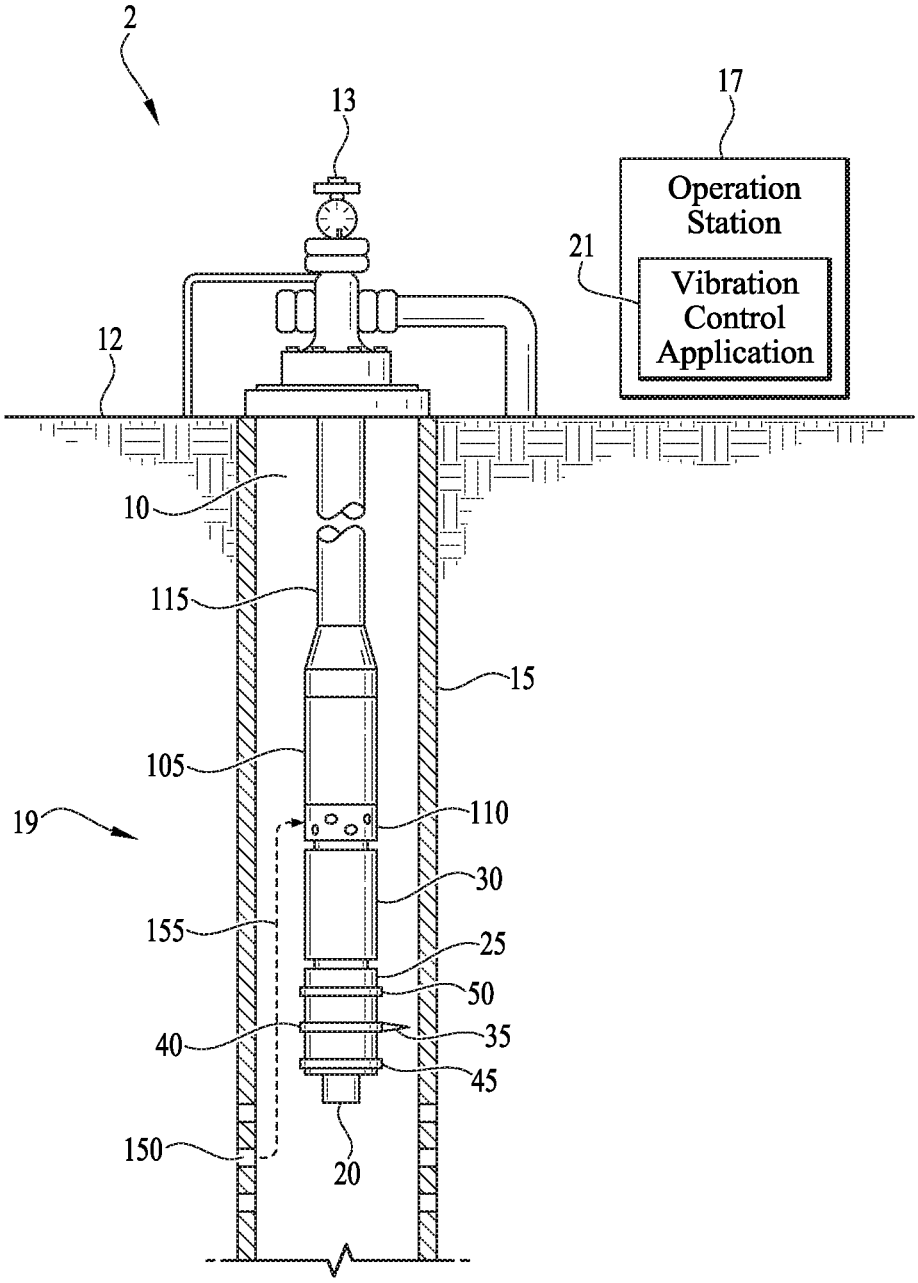
FIG. 1 is an illustration of an electric submersible pump (ESP) assembly disposed in a wellbore and an associated production environment according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," "down," "uphole," and "downhole" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid. "Downhole" is directed counter to the direction of flow of well fluid, towards the source of well fluid. "Uphole" is directed in the direction of flow of well fluid, away from the source of well fluid. As used herein, radial movement or direction refers to movement or direction that is perpendicular to (i.e., making a 90 degree angle with) the central axis of an ESP assembly at the associated location in the ESP assembly (for example, at an electric motor of an ESP assembly, at a centrifugal pump of an ESP assembly). As used herein, transversely displaced refers to displacement along a central axis of an ESP assembly, for example displacement or translation upwards substantially parallel to the central axis of the ESP assembly or displacement or translation downwards substantially parallel to the central axis of the ESP assembly.

Mechanical vibration is considered to be detrimental to electric submersible pump (ESP) assemblies. Mechanical vibration is thought to be responsible for premature wear in ESP components, for example causing keyway fretting wear. ESP assemblies commonly rotate at high rates of speed, for example at about 3450 RPM to about 3650 RPM. One approach in the past to reducing mechanical vibration has been to manufacture ESP components with tighter tolerances. For example, ESP drive shafts may be machined to high standards of straightness and pump impellers may be fabricated to conform to tight standards of symmetry and balance. A limitation to this approach to vibration mitigation, however, is that tight fabrication tolerances may quickly degrade in the aggressive downhole operating environment. For example, sand in the reservoir fluid may be accelerated by the pump and impact surfaces of impellers and diffusers at random locations, abrading the interior surfaces of the pump, making the previously precisely balanced impellers now imbalanced.

It is an insight and teaching of the present disclosure that placing the ESP assembly under tension in the wellbore can help to mitigate vibration. Not wishing to be limited by theory, it is thought that an ESP assembly under tension in the wellbore is less subject to vibration than an ESP assembly operating in a wellbore where it is free to move (e.g., is not wedged or otherwise tensioned against the casing walls). It may be that placing the ESP assembly under tension in the wellbore suppresses undesirable mechanical vibration resonance that would otherwise amplify rotational energy into significant vibration forces. The present disclosure contemplates a variety of different approaches to establishing a desired tension and/or a controlled amount of tension on the ESP assembly when it is deployed in the wellbore. This may be referred to as tensioning the ESP assembly in some contexts. The tension results from force applied to portions of the ESP assembly directed radially with reference to a central axis of the ESP assembly (i.e., force directed transversely to a central axis of the ESP assembly).

In an embodiment, a vibration control application executes on a computer system (e.g., on an operation station located at the surface proximate the wellhead) and commands actuators coupled to the ESP assembly to extend or retract to tension the ESP assembly in the wellbore and/or casing and thereby mitigate, attenuate, and/or prevent vibration of the ESP assembly above a vibration amplitude threshold. The vibration control application receives vibration sensor inputs from a vibration sensor coupled to the ESP assembly. The vibration control application determines or calculates actuator commands based on the vibration sensor inputs. The vibration control application then transmits the actuator commands to the actuators coupled to the ESP assembly. The vibration control application can therefore adapt the tensioning of the ESP assembly in the wellbore and/or in the casing to maintain ESP vibration below a vibration amplitude threshold as downhole conditions change—for example as properties and/or a flow rate of reservoir fluid into the ESP assembly change over time Turning now to FIG. 1, a system 2 is described. In an embodiment, the system 2 comprises a casing 15 located in a wellbore 10. An ESP assembly 19 comprising a sensor package 20, an electric motor 25, a seal section 30, a pump intake 110, and a centrifugal pump 105 is coupled to production tubing 115 that extends to the surface 12 and to a wellhead 13. In an embodiment, the sensor package 20 comprises one or more vibration sensors, for example one or more accelerometers, that produce one or more indications of vibration of the ESP assembly 19. In an embodiment, the ESP assembly 19 may comprise two or more centrifugal pumps.

In an embodiment, a first actuator 45 is coupled to the electric motor 25 or to the junction between the sensor package 20 and the bottom of the electric motor 25. In an embodiment, a second actuator 50 is coupled to the electric motor 25 or to the junction between the electric motor 25 and the pump intake 110. In an embodiment, a standoff 35 is coupled to the electric motor 25 by attachment hardware 40. The actuators 45, 50 and standoff 35 may be referred to as tensioning components.

In an embodiment, only one of the actuators 45, 50 is installed on the ESP assembly 19 and the standoff 35 is not installed on the ESP assembly 19. In an embodiment, two actuators 45, 50 are installed on the ESP assembly 19 and the standoff 35 is not installed on the ESP assembly 19. In an embodiment, the standoff 35 and only one of the actuators 45, 50 are installed on the ESP assembly 19. In an embodiment, both actuators 45, 50 and the standoff are installed on the ESP assembly 19. In another embodiment, one or more tensioning components may be attached to the centrifugal pump 105 instead of or in addition to on the electric motor 25. In another embodiment, one or more tensioning components may be attached to the seal section 30 instead of or in addition to on the electric motor 25 and/or to the centrifugal pump 105.

The ESP assembly 19 and associated tensioning components of the type described herein can be assembled at a wellsite and placed into the wellbore 10 to obtain a desired configuration and orientation of the type described herein, for example, and without limitation. An operation station 17 located at the surface 12 proximate to the wellhead 13 and to the wellbore 10 is communicatively coupled to the actuators 45, 50. In an embodiment, a computer system in the operation station 17 executes a vibration control application 21 that receives vibration sensor inputs from the sensor package 20, generates actuator control commands based on the vibration sensor inputs, and sends the actuator control commands to the actuators 45, 50. The vibration control application 21, through a sequence of actuator control commands sent to the actuators 45, 50, can manage a vibration of the ESP assembly 19 in the casing, for example to mitigate vibration of the ESP assembly 19.

The vibration control application 21 and a computer system are described further hereinafter. The operation station 17 and/or the vibration control application 21 may receive vibration sensor inputs and send actuator control commands via an electric power cable that provides electric power to the electric motor 25. The operation station 17 and/or the vibration control application 21 may receive vibration sensor inputs and send actuator control commands via a wireless communication link.

In another embodiment, the operation station 17 receives vibration sensor inputs from the sensor package 20 and presents information about those vibration sensor inputs to a human operator. The human operator can manipulate controls provided by the operation station 17 to command the actuators 45, 50, whereby to adapt a tension of the ESP assembly 19 in the casing 15 to manage a vibration of the ESP assembly 19, for example to mitigate vibration of the ESP assembly 19.

When the ESP assembly 19 operates, reservoir fluid 155 flows out of a subterranean formation through openings 150 in the casing 15 and into the wellbore 10. The reservoir fluid 155 enters the pump intake 110. The electric motor 25 receives electrical power from the surface 12 and turns a drive shaft that provides torque to the centrifugal pump 105. The centrifugal pump 105 pumps the reservoir fluid 150 and causes it to flow through the production tubing 115 to be produced at the wellhead 13.

The sensor package 20 may comprise one or more accelerometers that provide an indication of vibration to the operation station 17. If insignificant levels of vibration are sensed, it may not be desired to extend the members 55, 60 associated with the actuators 45, 50. If significant vibration is sensed, however, the operation station 17 may command the actuators 45, 50 to adjust (e.g., extend) their members 55, 60 as illustrated in and described with reference to FIG. 1A and FIG. 1B. By placing the electric motor 25 in a tensioned state in the casing 15, the tendency of the ESP assembly 19 to vibrate may be attenuated.

Figure 2A:
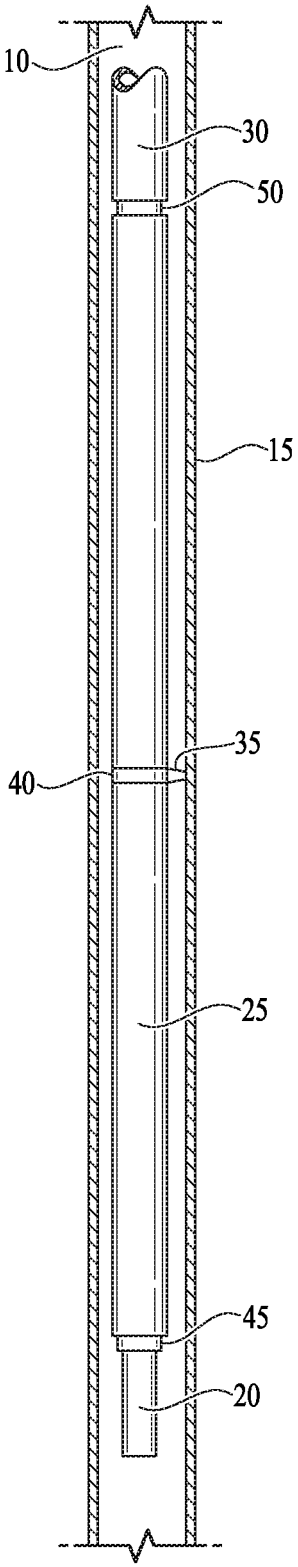
FIG. 2A and FIG. 2B are illustrations of a portion of an ESP assembly according to an embodiment of the disclosure.
Figure 2B:
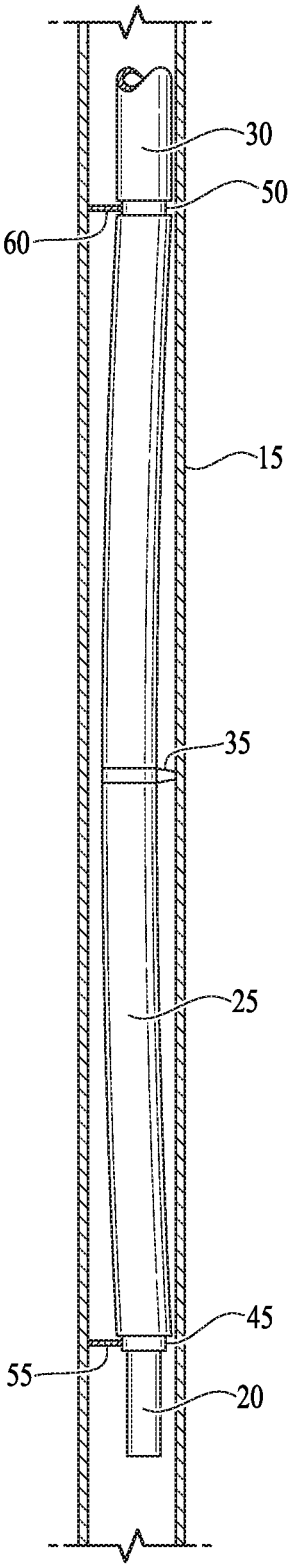

Tuning now to FIG. 2A and FIG. 2B, a portion of the ESP assembly 19 disposed in the casing 15 within the wellbore 10 is described. In FIG. 2A, the actuators 45, 50 are illustrated in an inactive or retracted state. The ESP assembly 19 is illustrated as having freedom to move within the casing 15. In casing 15 that has a relatively larger diameter, the ESP assembly 19 would have more freedom and may experience more vibration at least in part due to this greater freedom to move responsive to vibration forces.

In FIG. 2B, the first actuator 45 is illustrated as having extended a first member 55, and the second actuator 50 is illustrated as having extended a second member 60. The members 55, 60 extend and retract radially with respect to a central axis of the ESP assembly 19, for example substantially perpendicular to (e.g., making a 90 degree angle with) the central axis of the ESP assembly 19.

The members 55, 60 may be a threaded rod or a hydraulic piston such as a telescoping piston. The actuators 45, 50 may be electrically actuated or hydraulically actuated. As described above, the actuators 45, 50 may be commanded from the surface 12, for example from the operation station 17 and/or the vibration control application 21. Members 55, 60 exert force on the side of the casing 15 and drive the ESP assembly 19 away from that side of the casing 15 until the standoff 35 engages the casing 15 on the opposite side. As illustrated in FIG. 2B, the members 55, 60 drive the ESP assembly 19 to the right with reference to a centerline axis of the wellbore 10. The ESP assembly 19 is therefore tensioned in the casing 15. This tension is illustrated in FIG. 2B by a visible deformation or deflection of the electric motor 25. It is observed that this visible deformation is an exaggeration to help explain and describe the tensioning of the ESP assembly 19 in the casing 15. In practice, deformation of the electric motor 25 may be less than that illustrated in FIG. 2B and may not deform in measurable amount.

The first actuator 45 may be attached by attaching hardware to the ESP assembly 19, for example to a portion of the ESP assembly 19 having a reduced or narrowed outside diameter such as a narrowed portion of the outer housing of the electric motor 25 or a collar, connector, or reducer component located between the electric motor 25 and the sensor package 20. The second actuator 50 may be attached by attaching hardware to the ESP assembly 19, for example to a different portion of the ESP assembly 19 having a reduced or narrowed outside diameter such as a narrowed portion of the outer housing of the electric motor 25 or a collar, connector, or reducer component located between the electric motor 25 and the seal section 30. The attaching hardware may be a clamp comprising two C-shaped halves that are secured to the ESP assembly 19 (e.g., a narrowed portion of a component of the ESP assembly 19) with bolts and nuts. In another embodiment, different attaching hardware may be used to attach the actuators 45, 50 to the ESP assembly 19.

The standoff 35 may be static (e.g., fixed in size and placement) or dynamic/adjustable in size and/or placement. In an aspect, the standoff 35 is a static standoff comprising any suitable static member, for example a metallic rod, protrusion, or button, that is sized and/or configured to withstand the tension forces produced upon actuation of the actuators. For example, the standoff 35 may be a metallic protrusion sized to protrude outward from the outside diameter of a component of the ESP assembly 19 located proximate the standoff 35 by a distance of equal to or greater than about 0.5, 0.75, 1, 1.25, 1.5, 1.75, or 2 inches. The standoff 35 may be shaped to protrude about 0.5 inch from the ESP assembly 19. The standoff 35 may be shaped to protrude about 1 inch from the ESP assembly 19. The standoff 35 may be shaped to protrude about 1½ inch from the ESP assembly 19. In another embodiment, the standoff 35 may be shaped to protrude some other distance from the ESP assembly 19. The standoff 35 may have a beveled shape, a frustum shape, or a truncated cone shape that promotes ease of passing the ESP assembly 19 and the protruding standoff 35 into and out of the casing 15 without hanging up in the casing, for example without hanging up on junctions in multilateral wells. The standoff 35 may be formed of hardened metal. The standoff 35 may be formed of carbide metal or of titanium.

A static standoff 35 and/or a dynamic, active, or adjustable standoff 35 may be used in any of the embodiments disclosed herein. For example, a dynamic standoff may be used that corresponds in structure and/or function to an actuator of the type disclosed herein (e.g., actuators 45, 50). Reference to standoff (e.g., in the claims) is understood to mean either a static standoff or a dynamic standoff as appropriate to a given ESP assembly 19 and its intended wellbore installation and service.

The actuators 45, 50 may be commanded to extend the members 55, 60 to mitigate and/or prevent mechanical vibration of the ESP assembly 19 during operation thereof (e.g., during operation of the ESP assembly 19 to recover fluid such as hydrocarbons from the wellbore). The actuators 45, 50 may be commanded to retract the members 55, 60, for example in preparation for pulling the ESP assembly 19 out of the wellbore 10. If insignificant levels of vibration are sensed (e.g., sensed vibration amplitude below a predefined threshold), it may not be desired to extend the actuators 45, 50. If significant vibration is sensed, however, one or more of the actuators 45, 50 may be commanded by the operation station 17 and/or the vibration control application 21 to extend and/or adjust members 55, 60 as illustrated in FIG. 2B.

In an embodiment, the actuators 45, 50 may be actuated by electric motors (e.g., the actuators 45, 50 are configured to be electrically actuated). In an embodiment, the actuators 45, 50 may be actuated by hydraulic power (e.g., the actuators 45, 50 are configured to be hydraulically actuated). In an embodiment, the actuators 45, 50 may be electrically actuated lead screws (see FIG. 3 below). In an embodiment, the actuators 45, 50 may be hydraulically actuated telescoping pistons.

As seen in FIG. 2B, when the members 55, 60 are extended, the ESP assembly 19 may be driven over to the right relative to a centerline axis of the wellbore 10 so that the standoff 35 engages with the casing 15 on the one side of the ESP assembly 19 and the members 55, 60 engage with the casing 15 on the opposite side of the ESP assembly 19, thereby placing the ESP assembly in tension with respect to the contact point formed by contact of the standoff 35 with the casing 15. In an aspect, members 55, 60 apply a bending force to the ESP assembly 19 centered proximate the standoff 35, and the bending force may result in a desired amount of curvature in the ESP assembly 19. The resultant curvature may be small. In an embodiment, the curvature may result in a bend radius of about 1700 feet which corresponds to a bend of about 1 degree over a 30 foot portion of the ESP assembly 19 (if the bend is distributed over a longer portion of the ESP assembly 19, for example a 60 foot portion, the corresponding bend over that 60 foot portion may be about 2 degrees). In an embodiment, the curvature may result in a bend radius of about 3400 feet which corresponds to a bend of about 0.5 degree over a 30 foot portion of the ESP assembly 19. In an embodiment the curvature may result in a bend radius of about 5100 feet which corresponds to a bend of about 0.33 degree over a 30 foot portion of the ESP assembly 19. In an embodiment, the curvature may result in a bend of between about 0.01 degrees and about 2 degrees over a 30 foot portion of the ESP assembly 19.

The members 55, 60, in collaboration with the standoff 35, may be said to have tensioned the ESP assembly 19 in the wellbore 10 and/or the casing 15, thereby mitigating the tendency of the ESP assembly 19 to experience mechanical vibration, for example mitigating resonant vibrations. Without limitation of the disclosure, the use of the tensioning systems described herein may be preferably deployed in downhole environments where the ESP assembly 19 is free to move radially in the casing 15, for example in a wellbore 10 having relatively large diameter casing (e.g., having a diameter of from about 6⅝ inches to about 8⅝ inches). As an example, the tensioning system may be deployed when landing a 4 inch diameter ESP assembly 19 in 7 inch casing (e.g., where there is ample radial area and hence the ESP assembly 19 may have little or no contact with the casing 15). In relatively narrow casing (e.g., having a diameter of from about 4½ inches to about 5½ inches), the ESP assembly 19 may be somewhat restricted from radial motion by the casing 15 itself.

The standoff 35 may be located at a first radial orientation with respect to a central axis of the ESP assembly 19, and each of the actuators 45, 50 may be located so that the members 55, 60 extend radially from the central axis of the ESP assembly 19 in a direction about 180 degrees (e.g., +/−10, 9, 8, 7, 6, 5, 4, 3, 2, or 1 degrees) rotated about the central axis relative to the standoff 35. The actuators 45, 50 can be radially aligned with each other (e.g., within about +/−10, 9, 8, 7, 6, 5, 4, 3, 2, or 1 degrees).

In an embodiment, the ESP assembly 19 may have only the standoff 35 and one actuator, for example only the first actuator 45 or, alternatively, only the second actuator 50. If two actuators 45, 50 are installed, the vibration control application 21 or an operator commanding the actuators 45, 50 at the surface may choose to command only one actuator to extend its member in a given downhole context—for example command the first actuator 45 to extend the first member 55 while the second member 60 remains retracted within the second actuator 50, for example by commanding the second actuator 50 to extend the second member 60 while the first member 55 remains retracted within the first actuator 45. Furthermore, the extension length of first and second members 55, 60 may be varied relative to each other in order to provide a desired amount of tension across the ESP assembly 19. In an aspect, one or more performance parameters (e.g., degree of vibration) of the ESP assembly 19 are monitored over an operating interval of the ESP assembly 19 (e.g., over a predefined interval of time), and one or more of the actuators are adjusted to alter or control the performance parameter (degree of vibration).

In an example, the interval of time may be short, as for example during initial installation of the ESP assembly 19. In this case the ESP assembly 19 may be operated, vibration may be monitored, the actuators may be adjusted, the vibration may again be monitored, the actuators may again be adjusted, and this process continue until an initial configuration of the ESP assembly 19 and the actuators is established that results in an acceptable vibration. In another example, the interval of time may be long, as for example days, weeks, or months. After operating the ESP assembly 19 wear and erosion of components of the ESP assembly 19 may change the rotational balance of the ESP assembly 19, and vibration characteristics of the ESP assembly 19 may consequently change. Such vibration that may be the result of wear and erosion in the ESP assembly 19 may be monitored and actuators be adjusted in response to indications of such vibration to mitigate the vibration below an acceptable threshold level of vibration.

Figure 3:
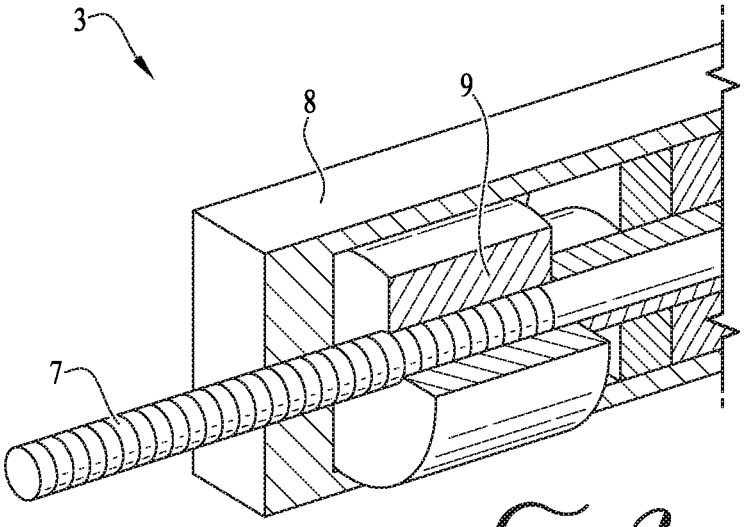
FIG. 3 is an illustration of an actuator according to an embodiment of the disclosure.

Turning now to FIG. 3, an electric lead screw actuator 3 is described. The electric lead screw actuator 3 comprises an extendable member 7, a housing 8, and an electric motor 9. When the electric motor 9 turns in a first sense, the member 7 extends. When the electric motor 9 turns in a second sense opposite of the first sense, the member 7 retracts. One or more of the actuators described herein may be implemented as the electric lead screw actuator 3.

Figure 4:
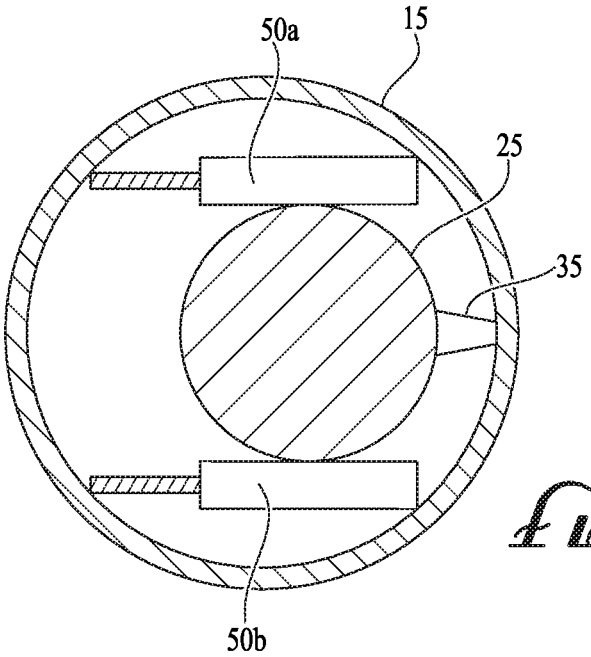
FIG. 4 is a cross-section illustration of an ESP assembly in a casing according to an embodiment of the disclosure.

Turning now to FIG. 4, further details of the actuator 50 are described. In an embodiment, the actuator 50 comprises an actuator 50*a* and an actuator 50*b*. The actuators 50*a*, 50*b* may be commanded in concert so that they both extend an equal amount and/or both retract an equal amount. The use of two actuators 50*a*, 50*b* as illustrated may promote applying a force to the ESP assembly 19 directed radially with respect to the central axis of the ESP assembly 19 (i.e., directed transverse to the central axis of the ESP assembly 19) and avoid applying a torsional force to the ESP assembly 19.

Figure 5A:
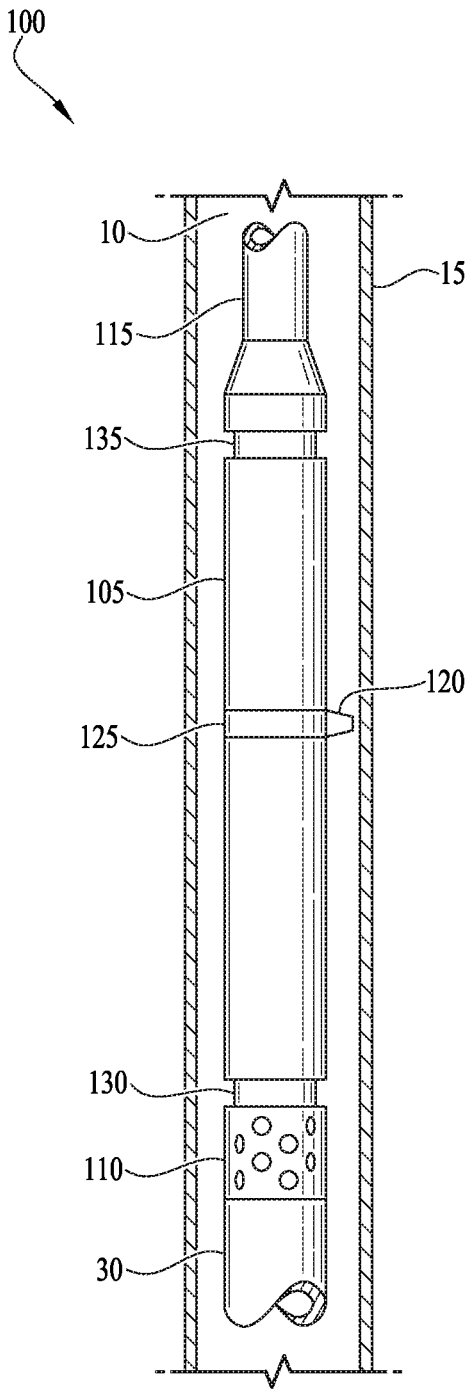
FIG. 5A and FIG. 5B are illustrations of another portion of an ESP assembly according to an embodiment of the disclosure.
Figure 5B:
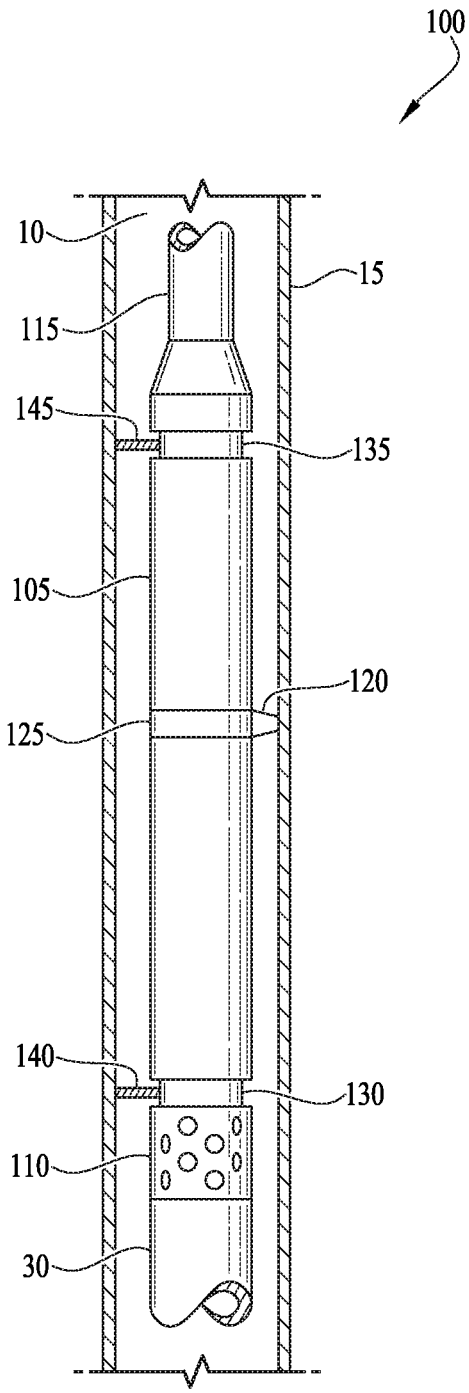

Turning now to FIG. 5A and FIG. 5B, an ESP assembly 100 is shown in the wellbore 10 within the casing 15. The assembly 100 shows that the tensioning components (e.g., standoff 35 and actuators 45, 50) coupled to the electric motor 25 may alternatively be coupled to other components of the ESP assembly. In an embodiment, the tensioning components may be coupled to two or more components of the same ESP assembly. For example, tensioning components may be coupled to both the electric motor 25 and the centrifugal pump 105. For example, tensioning components may be coupled to the electric motor 25 and the seal section 30. For example, tensioning components may be coupled to the seal section 30 and the centrifugal pump 105. For example, tensioning components may be coupled to the electric motor 25, the seal section 30, and the centrifugal pump 105. The actuators may all be independently controlled from the operation station 17.

As shown in FIG. 5A and FIG. 5B, the ESP assembly 100 comprises a centrifugal pump 105, a pump intake 110, and a standoff 120 coupled to the centrifugal pump 105 by eighth attaching hardware 125. A third actuator 130 is coupled to a lower end of the centrifugal pump 105, and a fourth actuator 135 is coupled to the upper end of the centrifugal pump 105. The third and fourth actuators 130, 135 may be substantially similar to the first and second actuators 45, 50 and the standoff 120 may be substantially similar to the standoff 35 described above with reference to FIG. 2A and FIG. 2B. The seal section 30 is coupled to the ESP assembly 100 below the pump intake 110. The electric motor 25 and the sensor package 20 may be coupled to the ESP assembly 100 below the seal section 30. The ESP assembly 100 is coupled to production tubing 115 that conducts reservoir fluid to the surface during operation of the ESP assembly 100.

In FIG. 5B, the third actuator 130 has extended a third member 140, and the fourth actuator 135 has extended a fourth member 145. In an embodiment, the actuators 130, 135 may be commanded from the surface proximate to the wellbore 10, for example from the operation station 17 and/or the vibration control application 21. The actuators 130, 135 may be commanded from the surface to extend and to retract. In an embodiment, the actuators 130, 135 may be actuated by electric motors as described herein. In an embodiment, the actuators 130, 135 may be actuated by hydraulic power as described herein. In an embodiment, the actuators 130, 135 may be electrically actuated lead screws as described herein.

The ESP assembly 100 may be driven over to the right relative to a centerline axis of the wellbore 10 so that the standoff 120 engages with the casing 15 on one side of the ESP assembly 100 and the members 140, 145 engage with the casing 15 on the opposite side (e.g., about 180 degrees opposite) of the ESP assembly 100. The members 140, 145 in collaboration with the standoff 120 may be said to have tensioned (e.g., applied a bending moment about standoff 120) the ESP assembly 100 in the wellbore 10 and/or in the casing 15, thereby mitigating the tendency of the ESP assembly 100 to experience mechanical vibration, for example mitigating resonant vibrations. The standoff 120 may be located at a first radial orientation with respect to a central axis of the ESP assembly 100, and each of the actuators 130, 135 may be located so that the members 140, 145 extend radially from the central axis of the ESP assembly 100 in a direction about 180 degrees (+/−10, 9, 8, 7, 6, 5, 4, 3, 2, or 1 degrees) radially rotated about the central axis of the wellbore 10 relative to the standoff 120.

Figure 6:
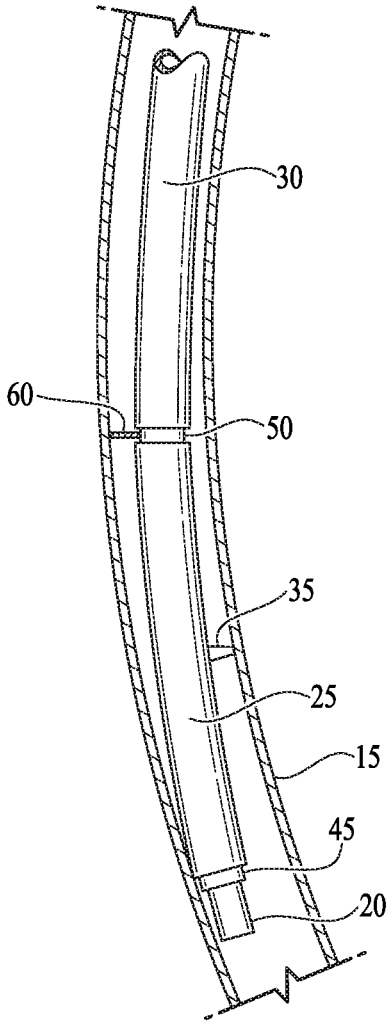
FIG. 6 is an illustration of an ESP assembly disposed in a bend in a wellbore according to an embodiment of the disclosure.

Turning now to FIG. 6, a disposition of the ESP assembly 19 in a bend of the casing 15 is described. In an embodiment, the ESP assembly 19 may be disposed at a bend in the casing 15 in the wellbore 10. As illustrated, a lower end of the ESP assembly 19 may contact the casing 15 on a left side of the centerline of the wellbore 10, the standoff 35 may contact the casing 15 on a right side of the centerline of the wellbore 10, and the upper end of the ESP assembly 19 (e.g., an upper end of the electric motor 25 and the ESP assembly 19 above the electric motor 25) may be free to move laterally within the casing 15. This lateral freedom may contribute to the build-up of vibration forces in the ESP assembly 19. As illustrated in FIG. 6, the member of the second actuator 50 has been extended to exert sideways directed force (force directed towards the right as illustrated) on the ESP assembly 19, thereby placing the ESP assembly 19 under tension. This tensioning of the ESP assembly 19 in this manner may mitigate vibration of the ESP assembly in operation.

Figure 7:
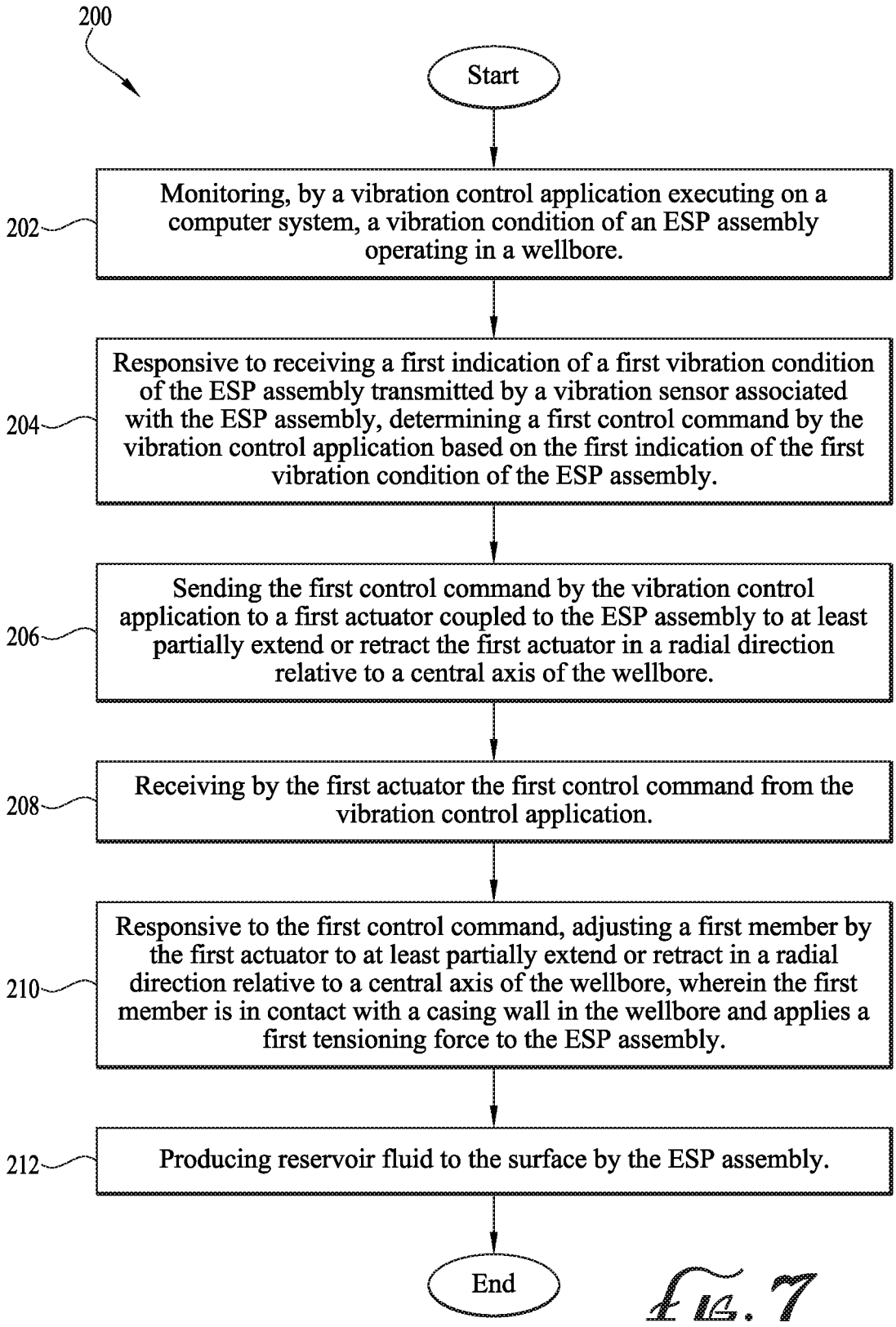
FIG. 7 is a flow chart of a method according to an embodiment of the disclosure.

Turning now to FIG. 7, a method 200 is described. In an embodiment, the method 200 is a method of producing reservoir fluid from an electric submersible pump (ESP) assembly. In an embodiment, the ESP assembly comprises an electric motor, a seal section, and a centrifugal pump. In an embodiment, the ESP assembly further comprises a sensor package having at least one vibration sensor (e.g., an accelerometer). Some of the processing of the method 200 may be performed by the vibration control application 21 executing on a computer system within the operation station 17 as well as by a sensor package (e.g., one or more vibration sensors and/or accelerometers) and by one or more actuators coupled to the ESP assembly downhole in a wellbore. At block 202, the method 200 comprises monitoring, by a vibration control application executing on a computer system, a vibration condition of an ESP assembly operating in a wellbore. The vibration control application may receive inputs from vibration sensors (e.g., accelerometers) coupled to the ESP assembly operating in the wellbore. The vibration control application may average or perform other statistical analysis on the inputs from the vibration sensors to determine an amplitude and/or magnitude of vibration being experienced by the ESP assembly.

At block 204, the method 200 comprises responsive to receiving a first indication of a first vibration condition of the ESP assembly transmitted by a vibration sensor associated with the ESP assembly, determining a first control command by the vibration control application based on the first indication of the first vibration condition of the ESP assembly. The processing of block 204 may depend on additional factors, for example depend on one or more earlier determined vibration conditions of the ESP assembly (e.g., a recent history or vibration conditions). The processing of block 204 may depend on the state of an actuator associated with the first control command. For example, if a member of an actuator is fully retracted, the processing of block 204 may determine a first control command corresponding to a greater amount of member extension than if the member of the actuator is already ¾ extended.

At block 206, the method 200 comprises sending the first control command by the vibration control application to a first actuator coupled to the ESP assembly to at least partially extend or retract the first actuator in a radial direction relative to a central axis of the ESP assembly. The vibration control application may cause the first control command to be sent via a wired communication link, for example as via a power line communication (PLC) wired communication link. The vibration control application may cause the first control command to be sent via a wireless communication link, for example via a wireless communication link to a wireless access point located at the wellhead, where the wireless access point relays the first control command downhole to the first actuator via a wired communication link, for example via a PLC wired communication link.

At block 208, the method 200 comprises receiving by the first actuator the first control command from the vibration control application. The processing of block 208 may comprise the first actuator determining that the first control command identifies the first actuator. The first actuator may be configured to ignore other control commands or other communication messages that do not comprise its own identity. At block 210, the method 200 comprises, responsive to the first control command, adjusting a first member by the first actuator to at least partially extend or retract in a radial direction relative to a central axis of the ESP assembly, wherein the first member is in contact with a casing wall in the wellbore and applies a first tensioning force to the ESP assembly. In an embodiment, the first actuator may comprise two parts, each part having a member, for example as discussed above with reference to FIG. 4. In an embodiment, the tensioning force comprises radial tension of the ESP assembly relative to the casing. In an embodiment, the tensioning force is radially directed relative to a central axis of the ESP assembly.

In an embodiment, the processing of blocks 202 through 208 may be reiterated periodically, for example every 5 minutes, every 15 minutes, every hour, every 4 hours, every 12 hours, once per day, once per week, or some other period of time. The processing of blocks 202 through 208 may be reiterated periodically every minute, every 30 seconds, every 15 seconds, every 5 seconds, every second, 5 times per second, or some other period of time. In an embodiment, the processing of blocks 202 through 208 is performed concurrently for each of a plurality of independently controlled actuators coupled to the ESP assembly. For example, in an embodiment, a second actuator is coupled to the ESP assembly, and the second actuator is configured to be commanded by the vibration control application independently of the first actuator. It is understood that the processing of block 204 may be performed for each actuator based on the states (retracted, extended, degree of retraction, degree of extension) of the other actuators.

The method 200 may further comprise sending a second control command by the vibration control application to the second actuator to at least partially extend or retract the second actuator in a radial direction relative to a central axis of the ESP assembly, receiving by the second actuator the second control command from the vibration control application, and responsive to the second control command, adjusting a second member by the second actuator to at least partially extend or retract in a radial direction relative to a central axis of the ESP assembly, wherein the second member is in contact with the casing wall in the wellbore and applies a second tensioning force to the ESP assembly.

At block 210, the method 200 comprises producing reservoir fluid to the surface by the ESP assembly.

Figure 8:
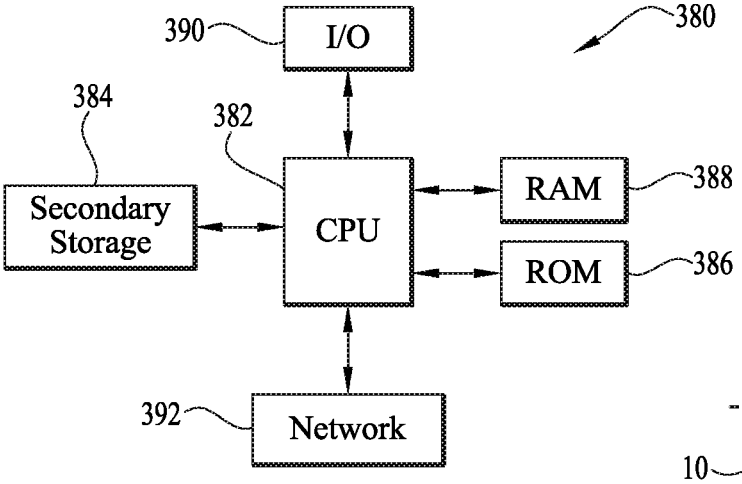
FIG. 8 is a block diagram of a computer system according to an embodiment of the disclosure.

Turning now to FIG. 8, a computer system 380 suitable for implementing one or more embodiments disclosed herein. For example a computer having some of the components of the computer system 380 may be used to execute the vibration control application 21. The computer system 380 includes a processor 382 (which may be referred to as a central processor unit or CPU) that is in communication with memory devices including secondary storage 384, read only memory (ROM) 386, random access memory (RAM) 388, input/output (I/O) devices 390, and network connectivity devices 392. The processor 382 may be implemented as one or more CPU chips.

It is understood that by programming and/or loading executable instructions onto the computer system 380, at least one of the CPU 382, the RAM 388, and the ROM 386 are changed, transforming the computer system 380 in part into a particular machine or apparatus having the novel functionality taught by the present disclosure. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

Additionally, after the system 380 is turned on or booted, the CPU 382 may execute a computer program or application (e.g., the vibration control application 21). For example, the CPU 382 may execute software or firmware stored in the ROM 386 or stored in the RAM 388. In some cases, on boot and/or when the application is initiated, the CPU 382 may copy the application or portions of the application from the secondary storage 384 to the RAM 388 or to memory space within the CPU 382 itself, and the CPU 382 may then execute instructions that the application is comprised of. In some cases, the CPU 382 may copy the application or portions of the application from memory accessed via the network connectivity devices 392 or via the I/O devices 390 to the RAM 388 or to memory space within the CPU 382, and the CPU 382 may then execute instructions that the application is comprised of. During execution, an application may load instructions into the CPU 382, for example load some of the instructions of the application into a cache of the CPU 382. In some contexts, an application that is executed may be said to configure the CPU 382 to do something, e.g., to configure the CPU 382 to perform the function or functions promoted by the subject application. When the CPU 382 is configured in this way by the application, the CPU 382 becomes a specific purpose computer or a specific purpose machine.

The secondary storage 384 is typically comprised of one or more disk drives or tape drives and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage 384. The RAM 388 is used to store volatile data and perhaps to store instructions. Access to both ROM 386 and RAM 388 is typically faster than to secondary storage 384. The secondary storage 384, the RAM 388, and/or the ROM 386 may be referred to in some contexts as computer readable storage media and/or non-transitory computer readable media.

I/O devices 390 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards, and/or other well-known network devices. The network connectivity devices 392 may provide wired communication links and/or wireless communication links (e.g., a first network connectivity device 392 may provide a wired communication link and a second network connectivity device 392 may provide a wireless communication link). Wired communication links may be provided in accordance with Ethernet (IEEE 802.3), Internet protocol (IP), time division multiplex (TDM), data over cable system interface specification (DOCSIS), wave division multiplexing (WDM), and/or the like. In an embodiment, the radio transceiver cards may provide wireless communication links using protocols such as code division multiple access (CDMA), global system for mobile communications (GSM), long-term evolution (LTE), WiFi (IEEE 802.11), Bluetooth, Zigbee, narrowband Internet of things (NB IoT), near field communications (NFC), radio frequency identity (RFID). The radio transceiver cards may promote radio communications using 5G, 5G New Radio, or 5G LTE radio communication protocols. These network connectivity devices 392 may enable the processor 382 to communicate with the Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave.

Such information, which may include data or instructions to be executed using processor 382 for example, may be received from and outputted to the network, for example, in the form of a computer data baseband signal or signal embodied in a carrier wave. The baseband signal or signal embedded in the carrier wave, or other types of signals currently used or hereafter developed, may be generated according to several methods well-known to one skilled in the art. The baseband signal and/or signal embedded in the carrier wave may be referred to in some contexts as a transitory signal.

The processor 382 executes instructions, codes, computer programs, scripts which it accesses from hard disk, floppy disk, optical disk (these various disk based systems may all be considered secondary storage 384), flash drive, ROM 386, RAM 388, or the network connectivity devices 392. While only one processor 382 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 384, for example, hard drives, floppy disks, optical disks, and/or other device, the ROM 386, and/or the RAM 388 may be referred to in some contexts as non-transitory instructions and/or non-transitory information.

In an embodiment, the computer system 380 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 380 to provide the functionality of a number of servers that is not directly bound to the number of computers in the computer system 380. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 380, at least portions of the contents of the computer program product to the secondary storage 384, to the ROM 386, to the RAM 388, and/or to other non-volatile memory and volatile memory of the computer system 380. The processor 382 may process the executable instructions and/or data structures in part by directly accessing the computer program product, for example by reading from a CD-ROM disk inserted into a disk drive peripheral of the computer system 380. Alternatively, the processor 382 may process the executable instructions and/or data structures by remotely accessing the computer program product, for example by downloading the executable instructions and/or data structures from a remote server through the network connectivity devices 392. The computer program product may comprise instructions that promote the loading and/or copying of data, data structures, files, and/or executable instructions to the secondary storage 384, to the ROM 386, to the RAM 388, and/or to other non-volatile memory and volatile memory of the computer system 380.

In some contexts, the secondary storage 384, the ROM 386, and the RAM 388 may be referred to as a non-transitory computer readable medium or a computer readable storage media. A dynamic RAM embodiment of the RAM 388, likewise, may be referred to as a non-transitory computer readable medium in that while the dynamic RAM receives electrical power and is operated in accordance with its design, for example during a period of time during which the computer system 380 is turned on and operational, the dynamic RAM stores information that is written to it. Similarly, the processor 382 may comprise an internal RAM, an internal ROM, a cache memory, and/or other internal non-transitory storage blocks, sections, or components that may be referred to in some contexts as non-transitory computer readable media or computer readable storage media.

Figure 9:
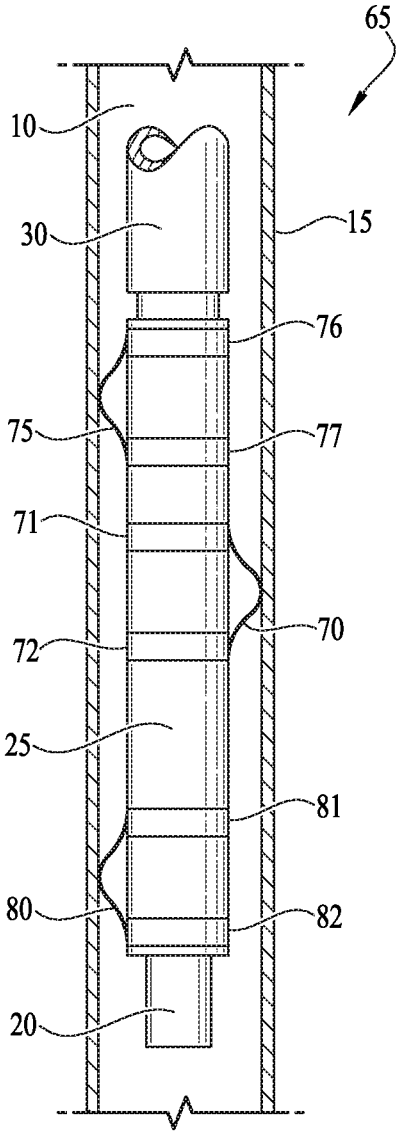
FIG. 9 is an illustration of a portion of an ESP assembly according to an embodiment of the disclosure.

Turning now to FIG. 9, a second ESP assembly 65 is shown in the wellbore 10 within the casing 15. In an embodiment, the ESP assembly 65 comprises the sensor package 20, the electric motor 25, the seal section 30, the pump intake 110, and the centrifugal pump 105 described above with reference to FIG. 1. The second ESP assembly 65 comprises a first leaf spring 70 secured to the ESP assembly 65 (e.g., proximate the center of the electric motor 25) by second attaching hardware 71 and third attaching hardware 72, a second leaf spring 75 secured to the ESP assembly 65 (e.g., proximate an upper end of the electric motor 25) by fourth attaching hardware 76 and fifth attaching hardware 77, and a third leaf spring 80 secured to the ESP assembly 65 (e.g., proximate a lower end of the electric motor 25) by sixth attaching hardware 81 and seventh attaching hardware 82. While reference is made to a leaf spring, any other suitable type of spring may be used to apply a tensioning force to the ESP assembly as described herein.

The leaf springs 70, 75, and 80 can be oriented about the ESP assembly 65 (e.g., electric motor 25) such that a bending moment or radius is applied to the ESP assembly 65, for example with a centrally positioned leaf spring (e.g., spring 70) serving as the focal point for the bending moment. The first leaf spring 70 may be oriented at a first radial orientation with respect to a central axis of the ESP assembly 65. The second leaf spring 75 and the third leaf spring 80 may be about radially aligned with each other (e.g., within about +/−10, 9, 8, 7, 6, 5, 4, 3, 2, or 1 degrees) and radially aligned rotated about 180 degrees (e.g., +/−10, 9, 8, 7, 6, 5, 4, 3, 2, or 1 degrees) with respect to the first leaf spring 70. Said in other words, the first leaf spring 70 is located at a first radial orientation with respect to a central axis of the ESP assembly 65, and the second and third leaf springs 75, 80 are located at about a second radial orientation that is rotated about 180 degrees with respect to the central axis of the ESP assembly 65 from the first radial orientation (i.e., from the location of the first leaf spring 70). The second leaf spring 75 is located transversely displaced from the first leaf spring 70 (e.g., located transversely displaced above the first leaf spring 70). The third leaf spring 80 is located transversely displaced from the first leaf spring 70 (i.e., located transversely displaced below the first leaf spring 70).

The spring force exerted by the first leaf spring 70 on the casing 15 may desirably be oppositely directed to the spring force exerted by the second leaf spring 75 and the third leaf spring 80 on the casing 15. The oppositely directed spring forces may be said to tension the ESP assembly 65 in the wellbore 10, thereby mitigating the tendency of the ESP assembly 65 to experience mechanical vibration, for example mitigating resonant vibrations.

The leaf springs 70, 75, 80 may each be formed of a single piece of metal having a desired shape such as rectangular, curved or bowed. The leaf springs 70, 75, 80 may each be formed of a plurality of pieces of metal of progressively different lengths. The leaf springs 70, 75, 80 may be secured by respective attaching hardware such that at least one end of each of the springs 70, 75, 80 is free to slide relative to (e.g., under) the attaching hardware, for example when the spring is depressed by contact with the casing 15. The leaf springs 70, 75, 80 may each protrude a distance (e.g., equal to or greater than about 0.5, 0.75, 1, 1.25, 1.5, 1.75, or 2 inches) from the side of the ESP assembly 65 when not in contact with the casing 15. The leaf springs 70, 75, 80 may each protrude about 0.5 inch from the side of the ESP assembly 65 when not in contact with the casing 15. The leaf springs 70, 75, 80 may each protrude about 1 inch from the side of the ESP assembly 65 when not in contact with the casing 15. The leaf springs 70, 75, 80 may each protrude about 1½ inches from the side of the ESP assembly 65 when not in contact with the casing 15. In an embodiment, the leaf springs 70, 75, 80 may each protrude some other distance from the side of the ESP assembly 65 when not in contact with the casing 15.

It is noted that the leaf springs 70, 75, and 80 are different from centralizers, at least in that centralizers contact the wellbore 10 or casing 15 in 360 degrees or about 360 degrees in contrast to the specific axial and radial orientation of the leaf springs (and likewise orientation of the actuators/standoff) as described in detail herein. Centralizers function to centralize components of a wellbore tubular, and thus act in a manner to reduce or alleviate tension in the wellbore tubular in contrast to the offset placement of the tensioning components (e.g., leaf springs, actuators, and standoff) described herein that are sized, spaced, and configured to impart tension into the ESP assembly 65. Additionally, centralizers are typically used to centralize casing for cementing the casing in the wellbore in contrast to an ESP assembly.

In an embodiment, the tensioning components (e.g., leaf springs 70, 75, 80 or standoff 35/actuators 45, 50) may be installed on both the electric motor 25 and on a centrifugal pump of the ESP assembly 65. In an embodiment, the tensioning components (e.g., leaf springs 70, 75, 80 or standoff 35/actuators 45, 50) may be installed on the electric motor 25, on the seal section 30, and on a centrifugal pump of the ESP assembly 65. In an embodiment, the tensioning components (e.g., leaf springs 70, 75, 80 or standoff 35/actuators 45, 50) may be installed on the seal section 30 alone or on the centrifugal pump alone. In an embodiment, the tensioning components (e.g., leaf springs 70, 75, 80 or standoff 35/actuators 45, 50) may be installed on the electric motor 25 and on the seal section 30 and not on the centrifugal pump. In an embodiment, the third leaf spring 80 may be coupled to the electric motor 25, the first leaf spring 70 may be coupled to the seal section 30, and the second leaf spring 75 may be coupled to the centrifugal pump of the ESP assembly 65. In another embodiment, some other distribution of the tensioning components (e.g., leaf springs 70, 75, 80 or standoff 35/actuators 45, 50) among the electric motor 25, the seal section 30, and the centrifugal pump of the ESP assembly 65 may be employed.

In an embodiment, a method of producing reservoir fluid from an electric submersible pump (ESP) assembly disposed in a wellbore is disclosed herein. The method comprises monitoring a vibration of an ESP assembly operating in a wellbore, for example from an operation station at a surface location proximate to the wellbore or located remote from the wellbore. The operation station may receive sensed vibration values from the sensor package 20, for example from one or more accelerometers in the sensor package 20. The sensor package 20 may transmit various sensed parameters via wireless or wired communication, for example via an electrical power cable to the operation station using, for example, power line communication (PLC) communication techniques or other communication techniques.

The method comprises sending an adjustment command from the operation station to an actuator coupled to the ESP assembly to radially extend or retract, either fully or partially, receiving the adjustment command by the actuator, and adjusting (e.g., extending) a member by the actuator to correspondingly adjust contact thereof with a casing wall in the wellbore. The adjusting the member by the actuator may cause the ESP assembly or component thereof to be placed under more or less radial tension in the casing, which may reduce, mitigate, or eliminate vibration of the ESP assembly or component thereof.

It is understood that this method may comprise independently performing the processing described above for any of a plurality of actuators, alone or in combination, that are coupled to the ESP assembly. For example, the operation station may command two actuators coupled to an electric motor of the ESP assembly to adjust (e.g., extend or retract, either partially or fully) their members. For example, the operation station may command two actuators coupled to the electric motor and two actuators coupled to a centrifugal pump of the ESP assembly to adjust (e.g., extend or retract, either partially or fully) their members. In an embodiment, when a plurality of actuators are coupled to the ESP assembly, each of the actuators may be commanded independently of the other actuators. Alternatively, in an embodiment, some of the actuators may be configured to respond to the same commands. The method also comprises producing reservoir fluid to the surface by the ESP assembly—the ESP assembly operates to produce reservoir fluid: the electric motor turning to generate mechanical torque, mechanical torque turning multiple stages of the centrifugal pump, reservoir fluid flowing into the pump intake being pumped by the centrifugal pump and flowing up production tubing to the surface. The operation of the ESP assembly may proceed with diminished mechanical vibration of the ESP assembly, and hence with a diminished rate of wear and tear on the ESP assembly, as a result of attenuation of vibration in the ESP assembly by the tensioning of the ESP assembly in the casing.

In an embodiment when a second actuator is coupled to the ESP assembly, the method may further comprise sending a second adjustment command from the operation station to the second actuator to radially extend or retract, either fully or partially; receiving the second adjustment command by the second actuator; and adjusting (e.g., extending) a second member by the second actuator to correspondingly adjust contact thereof with the casing wall in the wellbore. In an embodiment, the method further comprises sending a retract command (e.g., partially or fully retract) from the operation station to the first and/or second actuator to retract radially, receiving the retract command by the first and/or second actuator, and retracting the first member by the first actuator and/or the second member by the second actuator. The operation station may send a retract command to one or more actuators coupled to the ESP assembly when it is desired to pull the ESP assembly out of the casing.

In first aspect, a method comprises placing an ESP assembly into a wellbore and tensioning the ESP assembly against the wellbore wall such that vibration of one or more components of the ESP assembly is reduced during operation thereof.

In second aspect a method of operating an ESP assembly disposed in a wellbore comprises applying a tensioning force to the ESP assembly or a component thereof, wherein vibrations present in the ESP, wherein an amount of vibrations present in the ESP assembly or component thereof is less after applying the tensioning force than an amount of vibrations present in the ESP assembly or component thereof before applying the tensioning force. In third aspect, the tensioning force of the second aspect comprises radial tension or a bending moment.

In fourth aspect, a method of operating an ESP assembly disposed in a wellbore, comprises sensing a vibration condition of the ESP assembly or a component thereof while the ESP is in operation to yield a sensed ESP vibration condition, comparing the sensed ESP vibration condition to a threshold vibration condition, and, upon the sensed ESP vibration condition exceeding the threshold vibration condition, applying a tensioning force to the ESP assembly or a component thereof, wherein an amount of vibrations present in the ESP assembly or component thereof is reduced in comparison to an amount of vibrations present in the ESP assembly or component thereof before applying the tensioning force.

In a fifth aspect, an electric submersible pump (ESP) assembly comprises a first tensioning component and a second tensioning component, wherein the first and second tensioning components are configured to place the ESP assembly and/or a component thereof in radial tension relative to the wellbore, to apply a bending moment to the ESP assembly or a component thereof relative to each other, or both. In sixth aspect, the ESP assembly of the fifth aspect further comprises a third tensioning component, wherein the first tensioning component is positioned between the second and third tensioning components, and wherein the bending moment is focused about the first tensioning component. In a seventh aspect, the first, second, and/or third tensioning components of the fifth aspect or the sixth aspect are configured to receive a control command and positionally adjust responsive thereto. In an eighth aspect, each tensioning component of any of the fifth aspect, the sixth aspect, or the seventh aspect is independently selected from the group consisting of an electric actuator, a hydraulic actuator, a static standoff, a dynamic standoff, a spring, and combinations thereof. In a ninth aspect, the ESP assembly of any of the fifth aspect, the sixth aspect, the seventh aspect, or the eighth aspect, further comprising a vibration sensor coupled to the ESP assembly and configured to sense and transmit a vibration condition of the ESP assembly or a component thereof and a controller computer configured to receive the vibration condition from the vibration sensor to yield a received vibration condition; compare the received vibration condition to a threshold vibration condition; and upon the received vibration condition exceeding the threshold vibration condition, transmitting an adjustment commend to one or more of the tensioning components, wherein the adjustment command is effective to cause the one or more tensioning components to partially or fully extend or retract.

The present disclosure has taught a plurality of approaches to providing transverse tension to an ESP assembly operating in a producing well. The different approaches to providing transverse tension may be used in different downhole environments and/or production situations to obtain the benefits and advantages of mitigating vibration in the ESP assembly when operating downhole. Mitigating mechanical vibration in the ESP assembly can slow the rate of mechanical wear of the ESP assembly and extend the life of the ESP assembly. This can result in cost savings both in avoided production downtime (the time taken to pull the ESP assembly out of the wellbore, the time taken to run-in a replacement ESP assembly, and the time taken to bring the replacement ESP assembly on-line) and in spreading the capital costs of an ESP assembly over a longer service life.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

Additional Disclosure

The following are non-limiting, specific embodiments in accordance with the present disclosure:

A first embodiment, which is a system comprising an electric submersible pump (ESP) assembly, comprising a first actuator having a first member that is configured to extend and retract radially with respect to a central axis of the ESP assembly in response to receiving a control input, wherein the first actuator is mechanically coupled to an electric motor, to a seal section, or to a centrifugal pump of the ESP assembly.

A second embodiment, which is the system of the first embodiment, further comprising a standoff mechanically coupled to the electric motor, the seal section, or the centrifugal pump of the ESP assembly, wherein the first actuator is located on the ESP assembly so that the first member extends radially from a central axis of the ESP assembly in a direction 180 degrees rotated about the central axis relative to the standoff.

A third embodiment, which is the system of any of the first or the second embodiment, further comprising a second actuator having a second member that is configured to extend and retract radially in response to receiving a control input, wherein the second actuator is mechanically coupled to the electric motor, the seal section, or the centrifugal pump of the ESP assembly, and wherein the standoff is located between the second actuator and the first actuator.

A fourth embodiment, which is the system of any of the first through the third embodiments, wherein the standoff is a static standoff comprising a protrusion formed of hardened metal, carbide metal, or titanium.

A fifth embodiment, which is the system of the fourth embodiment, wherein the standoff has a beveled shape.

A sixth embodiment, which is the system of any of the third through the fifth embodiments, wherein the first actuator, the second actuator, or both is electrically actuated.

A seventh embodiment, which is the system of any of the third through the sixth embodiments, wherein the first actuator, the second actuator, or both is hydraulically actuated.

An eighth embodiment, which is the system of any of the first through the seventh embodiments, further comprising a sensor package having at least one vibration sensor mechanically coupled to the ESP assembly and a computer system located at the surface proximate a wellhead comprising a processor, a non-transitory memory, and a vibration control application stored in the non-transitory memory that, when executed by the processor monitors a vibration condition of the ESP assembly, receives inputs from the at least one vibration sensor that provides an indication of the vibration condition of the ESP assembly, determines control commands based on the vibration condition of the ESP assembly, and sends the control commands to one or more actuators mechanically coupled to the ESP assembly.

A ninth embodiment, which is an electric submersible pump (ESP) assembly, comprising a first leaf spring mechanically coupled to a component of the ESP assembly and located at a first radial orientation with respect to a central axis of the ESP assembly, and a second leaf spring mechanically coupled to a component of the ESP assembly and located at a second radial orientation that is rotated about 180 degrees with respect to the central axis of the ESP assembly from the location of the first leaf spring and located transversely displaced from the first leaf spring.

A tenth embodiment, which is the ESP assembly of the ninth embodiment, further comprising a third leaf spring mechanically coupled to a component of the ESP assembly and located at the second radial orientation that is rotated about 180 degrees with respect to the central axis of the ESP assembly from the location of the first leaf spring and located transversely displaced from the first leaf spring, wherein the first leaf spring is located transversely between the second leaf spring and the third leaf spring.

An eleventh embodiment, which is the ESP assembly of the tenth embodiment, wherein the first leaf spring is coupled to a first component of the ESP assembly, the second leaf spring is coupled to a second component of the ESP assembly, and the third leaf spring is coupled to a third component of the ESP assembly.

A twelfth embodiment, which is the ESP assembly of the tenth embodiment, wherein the first leaf spring, the second leaf spring, and the third leaf spring are all coupled to the same component of the ESP assembly.

A thirteenth embodiment, which is the ESP assembly of any of the ninth through the twelfth embodiments, wherein the components of the ESP assembly comprise an electric motor, a seal section, and a centrifugal pump.

A fourteenth embodiment, which is the ESP assembly of any of the ninth through the thirteenth embodiments, wherein the first leaf spring and the second leaf spring each comprise a single curved piece of metal.

A fifteenth embodiment which is a method of producing reservoir fluid from an electric submersible pump (ESP) assembly, comprising monitoring, by a vibration control application executing on a computer system, a vibration condition of an ESP assembly operating in a wellbore, responsive to receiving a first indication of a first vibration condition of the ESP assembly transmitted by a vibration sensor associated with the ESP assembly, determining a first control command by the vibration control application based on the first indication of the first vibration condition of the ESP assembly, sending the first control command by the vibration control application to a first actuator coupled to the ESP assembly to at least partially extend or retract the first actuator in a radial direction relative to a central axis of the ESP assembly, receiving by the first actuator the first control command from the vibration control application, responsive to the first control command, adjusting a first member by the first actuator to at least partially extend or retract in a radial direction relative to a central axis of the ESP assembly, wherein the first member is in contact with a casing wall in the wellbore and applies a first tensioning force to the ESP assembly, and producing reservoir fluid to the surface by the ESP assembly.

A sixteenth embodiment, which is the method of the fifteenth embodiment, wherein a second actuator is coupled to the ESP assembly and the second actuator is configured to be commanded by the vibration control application independently of the first actuator.

A seventeenth embodiment, which is the method of the sixteenth embodiment, further comprising sending a second control command by the vibration control application to the second actuator to at least partially extend or retract the second actuator in a radial direction relative to a central axis of the ESP assembly, receiving by the second actuator the second control command from the vibration control application, and responsive to the second control command, adjusting a second member by the second actuator to at least partially extend or retract in a radial direction relative to a central axis of the ESP assembly, wherein the second member is in contact with the casing wall in the wellbore and applies a second tensioning force to the ESP assembly.

An eighteenth embodiment, which is the method of any of the fifteenth through the seventeenth embodiments, wherein the tensioning force comprises radial tension of the ESP assembly relative to the casing.

A nineteenth embodiment, which is the method of any of the fifteenth through the eighteenth embodiments, wherein the ESP assembly comprises an electric motor, a seal section, and a centrifugal pump.

A twentieth embodiment, which is the method of any of the fifteenth through the nineteenth embodiments, further comprising receiving, by the vibration control application, a second indication of a second vibration condition of the ESP assembly transmitted by a vibration sensor associated with the ESP assembly, wherein an intensity of the second vibration condition is less than an intensity of the first vibration condition.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k* (Ru−Rl), wherein k is a variable ranging from 1 percent to 100 percent with a 1 percent increment, i.e., k is 1 percent, 2 percent, 3 percent, 4 percent, 5 percent, 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. An electric submersible pump (ESP) assembly, comprising:

an electric motor;

a seal section;

a centrifugal pump;

a first actuator having a first member that is configured to extend and retract radially with respect to a central axis of the ESP assembly in response to receiving a control input, wherein the first actuator is mechanically coupled to the ESP assembly; and a standoff mechanically coupled to the ESP assembly, wherein the first actuator is located on the ESP assembly so that the first member extends radially from a central axis of the ESP assembly in a direction 180 degrees rotated about the central axis relative to the standoff.

2. The ESP assembly of claim 1, further comprising a second actuator having a second member that is configured to extend and retract radially in response to receiving a control input, wherein the second actuator is mechanically coupled to the ESP assembly, and wherein the standoff is located between the second actuator and the first actuator.

3. The ESP assembly of claim 1, wherein the standoff is a static standoff comprising a protrusion formed of hardened metal, carbide metal, or titanium.

4. The ESP assembly of claim 3, wherein the standoff has a beveled shape.

5. The ESP assembly of claim 2, wherein the first actuator, the second actuator, or both is electrically actuated.

6. The ESP of claim 1, wherein the standoff has a frustum shape.

7. A system comprising:

an electric submersible pump (ESP) assembly, comprising:

an electric motor;

a seal section;

a centrifugal pump;

a first actuator having a first member that is configured to extend and retract radially with respect to a central axis of the ESP assembly in response to receiving a control input, wherein the first actuator is mechanically coupled to the ESP assembly; and a sensor package having at least one vibration sensor mechanically coupled to the ESP assembly and a computer system located at the surface proximate a wellhead comprising:

a processor;

a non-transitory memory; and a vibration control application stored in the non-transitory memory that, when executed by the processor monitors a vibration condition of the ESP assembly, receives inputs from the at least one vibration sensor that provides an indication of the vibration condition of the ESP assembly, determines control commands based on the vibration condition of the ESP assembly, and sends the control commands to one or more actuators mechanically coupled to the ESP assembly.

8. The system of claim 7, wherein the at least one vibration sensor is an at least one accelerometer.

9. The system of claim 7, wherein the ESP assembly further comprises a standoff mechanically coupled to the ESP assembly, wherein the first actuator is located on the ESP assembly so that the first member extends radially from a central axis of the ESP assembly in a direction 180 degrees rotated about the central axis relative to the standoff.

10. The system of claim 9, wherein the ESP assembly further comprises a second actuator having a second member that is configured to extend and retract radially in response to receiving a control input, wherein the second actuator is mechanically coupled to the ESP assembly, and wherein the standoff is located between the second actuator and the first actuator.

11. The system of claim 9, wherein the standoff has a beveled shape or a frustum shape.

12. The system of claim 9, wherein the first actuator is electrically actuated.

13. The system of claim 10, wherein the first actuator, the second actuator, or both is electrically actuated.

14. A method of producing reservoir fluid from an electric submersible pump (ESP) assembly, comprising:

monitoring, by a vibration control application executing on a computer system, a vibration condition of an ESP assembly operating in a wellbore, wherein the ESP assembly comprises an electric motor, a seal section, a centrifugal pump, a first actuator having a first member that is configured to extend and retract radially with respect to a central axis of the ESP assembly in response to receiving a control input, wherein the first actuator is mechanically coupled to the ESP assembly, and a standoff mechanically coupled to the ESP assembly, wherein the first actuator is located on the ESP assembly so that the first member extends radially from a central axis of the ESP assembly in a direction 180 degrees rotated about the central axis relative to the standoff;

responsive to receiving a first indication of a first vibration condition of the ESP assembly transmitted by a vibration sensor associated with the ESP assembly, determining a first control command by the vibration control application based on the first indication of the first vibration condition of the ESP assembly;

sending the first control command by the vibration control application to a first member coupled to the ESP assembly to at least partially extend or retract the first actuator in a radial direction relative to a central axis of the ESP assembly;

receiving by the first actuator the first control command from the vibration control application;

responsive to the first control command, adjusting the first member by the first actuator to at least partially extend or retract in a radial direction relative to a central axis of the ESP assembly, wherein the first member is in contact with a casing wall in the wellbore and applies a first tensioning force to the ESP assembly; and producing reservoir fluid to the surface by the ESP assembly.

15. The method of claim 14, wherein the ESP assembly comprises a second actuator coupled to the ESP assembly and the second actuator is configured to be commanded by the vibration control application independently of the first actuator.

16. The method of claim 15, further comprising:

sending a second control command by the vibration control application to the second actuator to at least partially extend or retract the second actuator in a radial direction relative to a central axis of the ESP assembly;

receiving by the second actuator the second control command from the vibration control application; and responsive to the second control command, adjusting a second member by the second actuator to at least partially extend or retract in a radial direction relative to a central axis of the ESP assembly, wherein the second member is in contact with the casing wall in the wellbore and applies a second tensioning force to the ESP assembly.

17. The method of claim 14, wherein the tensioning force comprises radial tension of the ESP assembly relative to the casing.

18. The method of claim 14, further comprising receiving, by the vibration control application, a second indication of a second vibration condition of the ESP assembly transmitted by a vibration sensor associated with the ESP assembly, wherein an intensity of the second vibration condition is less than an intensity of the first vibration condition.

19. The method of claim 14, wherein the standoff has a beveled shape.

20. The method of claim 14, wherein the standoff has a frustum shape.

* * * * *